US009320349B2

(12) United States Patent
Hwang

(10) Patent No.: US 9,320,349 B2
(45) Date of Patent: Apr. 26, 2016

(54) COSMETIC BRUSH

(71) Applicant: Jae Kwang Hwang, Seoul (KR)

(72) Inventor: Jae Kwang Hwang, Seoul (KR)

( * ) Notice: Subject to any disclaimer, the term of this patent is extended or adjusted under 35 U.S.C. 154(b) by 0 days.

(21) Appl. No.: 14/647,794

(22) PCT Filed: Oct. 29, 2013

(86) PCT No.: PCT/KR2013/009688

§ 371 (c)(1),
(2) Date: May 27, 2015

(87) PCT Pub. No.: WO2014/084514

PCT Pub. Date: Jun. 5, 2014

(65) Prior Publication Data

US 2015/0296968 A1 Oct. 22, 2015

(30) Foreign Application Priority Data

Nov. 30, 2012 (KR) ..... 10-2012-0137659

(51) Int. Cl.

| | |
|---|---|
| ***A46B 7/02*** | (2006.01) |
| ***A46B 9/02*** | (2006.01) |
| ***A45D 33/00*** | (2006.01) |
| ***A45D 40/26*** | (2006.01) |
| ***A46B 5/00*** | (2006.01) |
| ***A45D 34/04*** | (2006.01) |

(52) U.S. Cl.

CPC ..... *A46B 7/026* (2013.01); *A45D 33/00* (2013.01); *A45D 34/042* (2013.01); *A45D 40/262* (2013.01); *A46B 5/0008* (2013.01); *A46B 5/0012* (2013.01); *A46B 9/021* (2013.01)

(58) Field of Classification Search

CPC .... A46B 7/026; A46B 5/0008; A46B 5/0012; A46B 9/021; A46B 11/0079; A46B 11/0055; A46B 2200/1046; A45D 33/00; A45D 40/262; A45D 33/02; A45D 33/34

See application file for complete search history.

(56) References Cited

U.S. PATENT DOCUMENTS 7,275,885 B2 * 10/2007 Byun ..... A45D 33/02 401/278

FOREIGN PATENT DOCUMENTS

| | | | |
|---|---|---|---|
| KR | 20-0361620 | Y1 | 9/2004 |
| KR | 10-0522305 | B1 | 10/2005 |
| KR | 20-0406850 | Y1 | 1/2006 |
| KR | 20-0436628 | Y1 | 9/2007 |
| WO | 2009/031851 | A2 | 3/2009 |

* cited by examiner

*Primary Examiner* — Shay Karls

(74) *Attorney, Agent, or Firm* — Novick, Kim & Lee, PLLC; Jae Youn Kim

(57) ABSTRACT

A cosmetic brush is provided, including a large brush having a large diameter; a small brush having a small diameter inserted into a center in the large brush; a large brush body connected to a lower end of the large brush; and a vertical operating member that operates the small brush so as to protrude to the center of the large brush by lowering the large brush body. According to the present cosmetic brush, by simultaneously including the large brush having the large diameter and the small brush having the small diameter inserted into the large brush, there is an effect of being able to selectively use the large brush and the small brush depending on the form of the makeup.

5 Claims, 5 Drawing Sheets

COSMETIC BRUSH

BACKGROUND OF THE INVENTION

1. Technical Field

The present disclosure relates to a cosmetic brush. More particularly, it relates to a cosmetic brush which enables a user to selectively use brushes with a large diameter or a small diameter.

2. Background Art

According to Korean Registered Utility Model Publication No. 0436628, when a women typically performs facial makeup, she selectively uses a suitable cosmetic brush depending on makeup sites. As types of cosmetic brushes used for the facial makeup, there are a facial cosmetic brush for making up cheeks and forehead, an eye makeup brush used for eyes, a lip brush for making up the lips and the like, and since the colors of makeup cosmetics are also various, several cosmetic brushes are required to match the color of various makeup cosmetics for each brush.

Therefore, there have been many inconveniences that, in order to put on makeup, women not only need to carry or keep several cosmetic brushes but need to use after finding one thing or another. Especially, since makeup professions such as makeup artists need to carry a particularly large number of cosmetic brushes, they have felt a lot of inconvenience.

DISCLOSURE

Technical Problem

The present invention has been made in an effort to solve the above-described problems, and an object thereof is to provide cosmetic brush that enables a large brush and a small brush to be selectively used to meet the form of makeup, by simultaneously including the large brush having a large diameter and a small brush inserted into the large brush.

Technical Solution

According to a first aspect of the preset invention, there is provided a cosmetic brush that includes a large brush 10 having a large diameter; a small brush 20 having a small diameter inserted into a center in the large brush 10; a large brush body 30 connected to a lower end of the large brush 10; and a vertical operating member 40 that operates the small brush 20 so as to protrude to the center of the large brush 10 by lowering the large brush body 30.

The large brush 10 is attached to an upper surface of the large brush body 30, a cylindrical column 31 having an open bottom is formed at the inner center of the bottom side that is opened to the bottom, and a catching protrusion 32 protruding toward the inner side of the lower end surface is formed on the lower end surface of the cylindrical column 31.

A cylindrical small brush body 21 is connected to the lower end of the small brush 20, and a cylindrical connecting column member 50, which vertically moves the small brush 20 depending on vertical movement of the vertical operating member 40, is inserted and installed into a lower end inner circumferential surface of the small brush body 21.

The vertical operating member 40 is opened at the top and is closed on the bottom surface, and is formed with a plurality of vent holes 41. A circular protruding handle 42 serving as a handle configured to vertically move the vertical operating member 40 protrudes to the outer circumferential side of the lower end surface, and catching protrusions 43 are formed on the central inner side of the lower end surface so as to be fitted and coupled to the lower end inner circumferential surface of the connecting column member 50.

In the outer circumferential surface middle and bottom side of the connecting column member 50, catching grooves 51 are each formed so that the catching protrusions 32 of the large brush body 30 are inserted and caught depending on the vertical movement of the connecting column member 50, and a gear-shaped protrusion 52 is formed on the upper outer circumferential surface such that the small brush body 21 is inserted.

Advantageous Effect

According to the present invention, by simultaneously including the large brush 10 having the large diameter and the small brush 20 having the small diameter inserted into the large brush, there is an effect of being able to selectively use the large brush and the small brush depending on the form of the makeup.

BRIEF DESCRIPTION OF THE DRAWINGS

The above objects, other features and advantages of the present invention will become more apparent by describing the preferred embodiments thereof with reference to the accompanying drawings, in which.

PREFERRED EMBODIMENTS OF THE INVENTION

Now, preferred embodiments of the present invention will be described in detail with reference to the accompanying drawings. The matters defined in the description, such as the detailed construction and elements, are nothing but specific details provided to assist those of ordinary skill in the art in a comprehensive understanding of the invention, and the present invention is not limited to the embodiments disclosed hereinafter. Other objects, features, and advantages will be apparent through the detailed description of the embodiments with reference to the accompanying drawings.

Hereinafter, preferred embodiments of the present invention will be described in detail with reference to the accompanying drawings. Furthermore, in the explanation of the present invention, when it is determined that the specific description of associated known configurations or functions can obscure the subject matter of the present invention, the detailed description thereof will not be provided.

EXAMPLE

Figure 1:
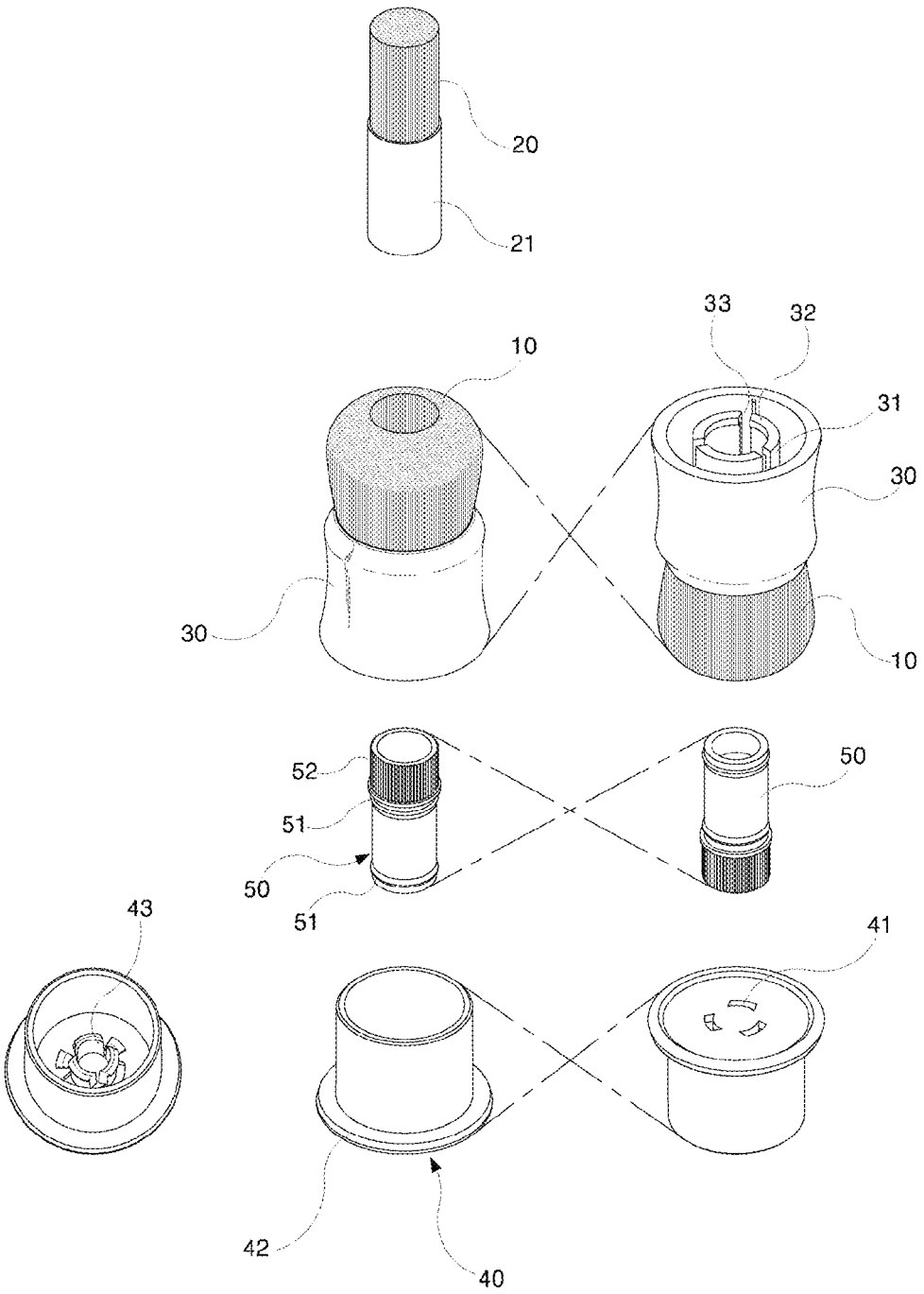
FIG. 1 is an exploded perspective view illustrating a cosmetic brush of the present invention.
Figure 2:
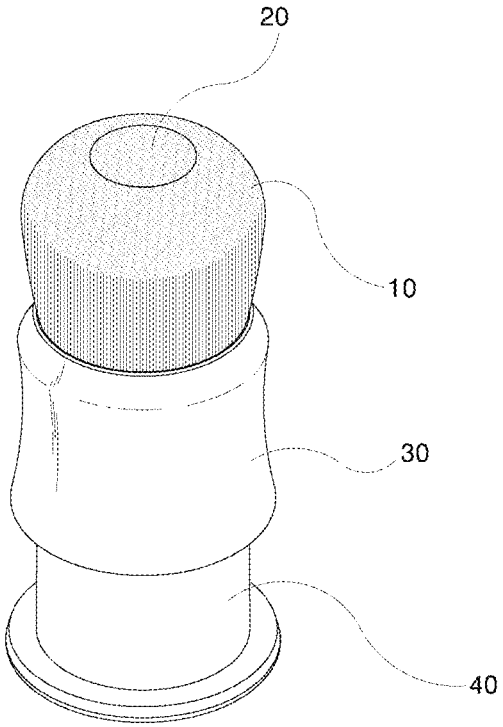
FIG. 2 is an assembled perspective view illustrating the cosmetic brush of the present invention.
Figure 3:
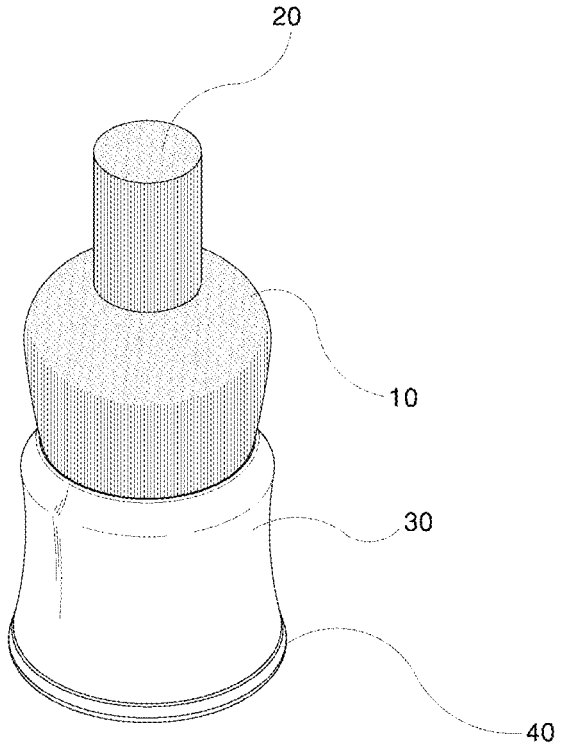
FIG. 3 is a perspective view illustrating a state in which the cosmetic brush of a small diameter of the present invention protrudes.
Figure 4:
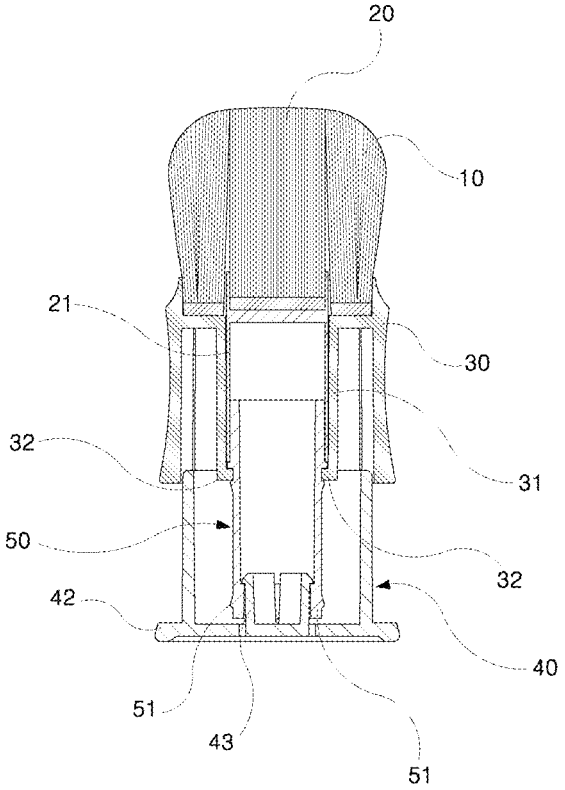
FIG. 4 is a cross-sectional view of FIG. 2.
Figure 5:
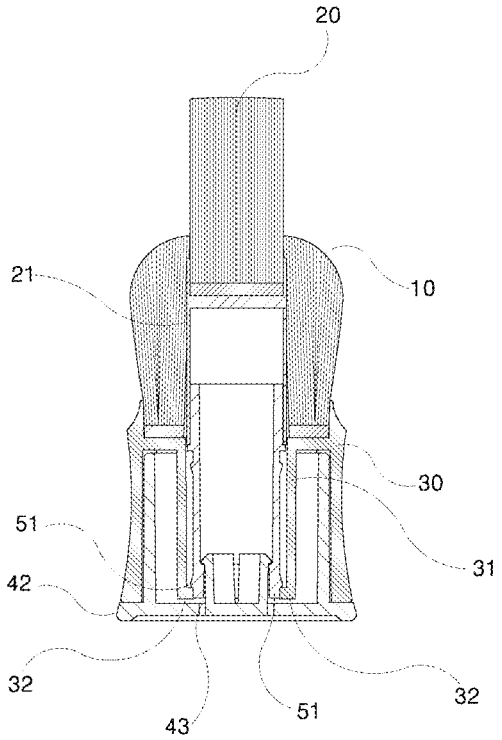
FIG. 5 is a cross-sectional view of FIG. 3.

FIG. 1 is an exploded perspective view illustrating a cosmetic brush of the present invention, FIG. 2 is an assembled perspective view illustrating the cosmetic brush of the present invention, FIG. 3 is a perspective view illustrating a state in which the cosmetic brush of a small diameter of the present invention protrudes, FIG. 4 is a cross-sectional view of FIG. 2 and FIG. 5 is a cross-sectional view of FIG. 3.

As illustrated in FIGS. 1 to 5, a cosmetic brush according to the present invention includes a large brush 10 having a large diameter; a small brush 20 having a small diameter inserted into a center in the large brush 10; a large brush body 30 connected to a lower end of the large brush 10; and a vertical operating member 40 that operates the small brush 20 so as to protrude to the center of the large brush 10 by lowering the large brush body 30.

The large brush 10 is attached to an upper surface of the large brush body 30, and a cylindrical column 31 having an open bottom is formed at the inner center of the bottom side that is opened to the bottom. A catching protrusion 32 protruding toward the inner side of the lower end surface is formed on the lower end surface of the cylindrical column 31.

A cylindrical small brush body 21 is connected to the lower end of the small brush 20, and a cylindrical connecting column member 50, which vertically moves the small brush 20 depending on the vertical movement of the vertical operating member 40, is inserted and installed into a lower end inner circumferential surface of the small brush body 21.

The vertical operating member 40 has an open top and a closed bottom surface, and is formed with a plurality of vent holes 41. A circular protruding handle 42 serving as a handle configured to vertically move the vertical operating member 40 protrudes to the outer circumferential side of the lower end surface, and catching protrusions 43 are formed on the central inner side of the lower end surface so as to be fitted and coupled to the lower end inner circumferential surface of the connecting column member 50.

The cylindrical column 31 is formed with cutting sections 33 at the same interval in a longitudinal direction such that the connecting post member 50 is elastically and vertically moved.

In the outer circumferential surface middle and bottom side of the connecting column member 50, catching grooves 51 are each formed so that the catching protrusions 32 of the large brush body 30 are inserted and caught depending on the vertical movement of the connecting column member 50, and a gear-shaped protrusion 52 is formed on the upper outer circumferential surface such that the small brush body 21 is inserted.

Next, the operation and effect of the present invention having the above-described configuration will be described.

First, the assembly process will be explained. Each of the large brush 10 and the small brush 20 are attached to the large brush body 30 and the small brush body 21, the small brush body 21 is inserted through the center of the large brush 10, and the gear-shaped protrusion 52 of the upper end of the connecting column members 50 is inserted into the lower end of the small brush body 21.

The catching protrusions 43 of the vertical operating member 40 is inserted into in the lower end inner circumferential surface of the connection column member 50.

Thus, the assembly is completed. A lowered state of the vertical operating member 40 is a state illustrated in FIG. 2. This is intended to use the large brush 10. In the case of trying to use the small brush 20, when raising the vertical operating member 40, as illustrated in FIG. 5, the catching protrusions 32 of the large brush body 30 are detached from the upper catching grooves 51 formed on the outer circumferential surface of the connecting post member 50, the connecting column member 50 rises, and the small brush 10 protrudes to the top center of the large brush 10. At the same time, the catching protrusions 32 of the large brush 30 are inserted into the lower catching grooves 51 of the connecting column member 50, and protrusion state of the small brush 20 is maintained.

Conversely, in the case of trying to use the large brush 10, when pulling the circular protruding handle 42 of the vertical operating member 40 downward, the catching protrusions 32 are detached from the lower catching grooves 51, and the small brush body 21 connected to the connecting column member 50 is lowered. As illustrated in FIG. 4, the catching protrusions 32 are inserted into the upper catching grooves 51 again, and the small brush 20 is in the state of being hidden inside the larger brush 10.

Thus, in the present invention, by simultaneously including the large brush 10 having a large diameter and the small brush 20 inserted into the large brush 10, the large brush and the small brush can be selectively used depending on the form of makeup.

Although the specific embodiments have been described in the detailed description of the invention above, it is apparent that the technique of the present invention can be readily modified by those skilled in the art, and such modified embodiments may be included in the technical idea described in the claims of the present invention.

DESCRIPTION OF REFERENCE NUMERAL

10: large brush
20: small brush
21: small brush body
30: large brush body
31: cylindrical column
32: catching protrusion
40: vertical operating member
41: plurality of vent holes
42: circular protruding handle
43: catching protrusion
50: connecting column member
51: catching groove
52: gear-shaped protrusion

What is claimed is:

1. A cosmetic brush comprising:

a first brush having a diameter;

a second brush having a smaller diameter than that of the first brush, the second brush is configured to be inserted into a center hole of the first brush;

a first brush body connected to a lower end of the first brush and including a cylindrical hollow column disposed inside the first brush body, the cylindrical hollow column having a catching protrusion disposed at a lower end edge thereof and protruding in an inward radial direction of the cylindrical hollow column from the lower end edge;

a cylindrical connecting column member including an upper catching groove and a lower catching groove disposed lower than the upper catching groove on an outer circumferential surface of the cylindrical connecting column member; and a vertical operating member fixed to a bottom portion of the cylindrical connecting column member, wherein the catching protrusion is configured to engage with the upper catching groove and the lower catching groove respectively when the cylindrical hollow column moves up and down between the upper catching groove and the lower catching groove.

2. The cosmetic brush of claim 1, further comprising a cylindrical second brush body connected to a lower end of the second brush.

3. The cosmetic brush of claim 2, wherein the vertical operating member includes a cylindrical wall having an open top and a bottom plate having a bottom surface and connected to the cylindrical wall, a plurality of vent holes disposed on the bottom plate, a circular protruding handle configured to vertically move the vertical operating member and protruding in an outward radial direction from an outer circumferential surface of the cylindrical wall and extending from the bottom plate, and catching protrusions disposed on a central inner side of the bottom plate so as to be fitted and coupled to a lower end inner circumferential surface of the cylindrical connecting column member.

4. The cosmetic brush of claim 3, further comprising a gear-shaped protrusion disposed on an upper outer circumferential surface of the cylindrical connecting column member such that the cylindrical second brush body is fixed thereto.

5. The cosmetic brush of claim 2, wherein the cylindrical hollow column includes cutting sections disposed at a same distance therebetween in a longitudinal direction such that the cylindrical hollow column is elastically and vertically moved on the outer circumferential surface of the cylindrical connecting column member.

* * * * *